US010018960B2

(12) United States Patent
Itabashi

(10) Patent No.: US 10,018,960 B2
(45) Date of Patent: Jul. 10, 2018

(54) DEVELOPING CARTRIDGE INCLUDING ELECTRIC CONTACT SURFACE

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/467,636

(22) Filed: Mar. 23, 2017

(65) Prior Publication Data

US 2018/0046131 A1 Feb. 15, 2018

(30) Foreign Application Priority Data

Aug. 10, 2016 (JP) ..... 2016-157524

(51) Int. Cl.
*G03G 21/16* (2006.01)
*G03G 21/18* (2006.01)

(52) U.S. Cl.
CPC ..... *G03G 21/1652* (2013.01); *G03G 21/1647* (2013.01); *G03G 21/1676* (2013.01); *G03G 21/1867* (2013.01)

(58) Field of Classification Search
CPC ..... G03G 21/1652; G03G 21/1647; G03G 21/1676; G03G 21/1867
See application file for complete search history.

(56) References Cited

U.S. PATENT DOCUMENTS 5,873,012 A * 2/1999 Miyabe ..... G03G 21/1825 399/111
5,878,309 A * 3/1999 Nomura ..... G03G 21/181 399/111

(Continued)

FOREIGN PATENT DOCUMENTS

EP 3 101 483 A1 12/2016
JP 2003-195726 A 7/2003

(Continued)

OTHER PUBLICATIONS

European Search Report issued in related European Patent Application No. 17162946.2, dated Sep. 20, 2017.

(Continued)

*Primary Examiner* — Rodney Bonnette
(74) *Attorney, Agent, or Firm* — Merchant & Gould P.C.

(57) ABSTRACT

A developing cartridge includes: a developing roller; a casing for accommodating therein developing agent; a storage medium including an electric contact surface; a holder movable along with the electric contact surface in a first direction crossing the electric contact surface, the holder being movable between a first position and a second position relative to the casing in the first direction; and a pressure member for pressing the holder while being moved in a second direction crossing the first direction when the holder is moved between the first position and the second position. A distance in the first direction between the electric contact surface and the pressure member when the holder is positioned at the first position is greater than a distance in the first direction between the electric contact surface and the pressure member when the holder is positioned at the second position.

17 Claims, 17 Drawing Sheets

(56) References Cited

U.S. PATENT DOCUMENTS

| | | | | |
|---|---|---|---|---|
| 2011/0064451 | A1 | 3/2011 | Okabe et al. | |
| 2011/0129252 | A1 | 6/2011 | Oda et al. | |
| 2013/0051849 | A1 | 2/2013 | Itabashi et al. | |
| 2013/0266340 | A1* | 10/2013 | Hashimoto | G03G 21/1676 399/119 |
| 2017/0184998 | A1* | 6/2017 | Itabashi | G03G 15/0865 |
| 2017/0185032 | A1* | 6/2017 | Itabashi | G03G 15/0875 |

FOREIGN PATENT DOCUMENTS

| | | | |
|---|---|---|---|
| JP | 2011-59510 | A | 3/2011 |
| JP | 2012-234190 | A | 11/2012 |
| JP | 2013-054058 | A | 3/2013 |

OTHER PUBLICATIONS

International Search Report and Written Opinion from related International Patent Application No. PCT/JP2017/011864, dated May 9, 2017.

* cited by examiner

DEVELOPING CARTRIDGE INCLUDING ELECTRIC CONTACT SURFACE

CROSS REFERENCE TO RELATED APPLICATION

This application claims priority from Japanese Patent Application No. 2016-157524 filed Aug. 10, 2016. The entire content of the priority application is incorporated herein by reference.

TECHNICAL FIELD

The present disclosure relates to a developing cartridge.

BACKGROUND

An electro-photographic type image forming apparatus such as a laser printer and an LED printer is known in the art. The apparatus uses a developing cartridge including a developing roller for supplying toner.

Prior art discloses a developing cartridge attachable to a drawer unit. The drawer unit includes a photosensitive drum. In a case where the developing cartridge is attached to the drawer unit, the photosensitive drum faces the developing roller. The drawer unit to which the developing cartridge is attached is inserted into the image forming apparatus.

Prior art also discloses a developing cartridge attachable to a drum unit including a photosensitive drum. In a care where the developing cartridge is attached to the drum unit, the photosensitive drum faces the developing roller. The drum unit to which the developing cartridge is attached is inserted into the image forming apparatus.

Further, a developing cartridge including a storage medium such as IC chip is also known. The storage medium includes an electrical contact surface in contact with an electrical connector of an image forming apparatus or the drawer unit.

SUMMARY

However, the electric contact surface may be scraped against a protruding part of the image forming apparatus or the drawer unit during attachment of the developing cartridge to the image forming apparatus or the drawer unit.

It is therefore an object of the disclosure to provide a developing cartridge capable of reducing scraping of the electric contact surface during attachment of the developing cartridge.

According to one aspect, there is provided a developing cartridge including: a developing roller; a casing configured to accommodate therein developing agent; a storage medium including an electric contact surface; a holder movable along with the electric contact surface in a first direction crossing the electric contact surface, the holder being movable between a first position and a second position relative to the casing in the first direction; and a pressure member configured to press the holder while the pressure member moves in a second direction crossing the first direction, in a case where the holder moves between the first position and the second position. A distance in the first direction between the electric contact surface and the pressure member in a case where the holder is positioned at the first position is greater than a distance in the first direction between the electric contact surface and the pressure member in a case where the holder is positioned at the second position.

BRIEF DESCRIPTION OF THE DRAWINGS

The particular features and advantages of the disclosure will become apparent from the following description taken in connection with the accompanying drawings, in which.

DETAILED DESCRIPTION

A developing cartridge according to one embodiment will be described with reference to FIGS. 1 through 12.

1. Outline of Developing Cartridge

Figure 1:
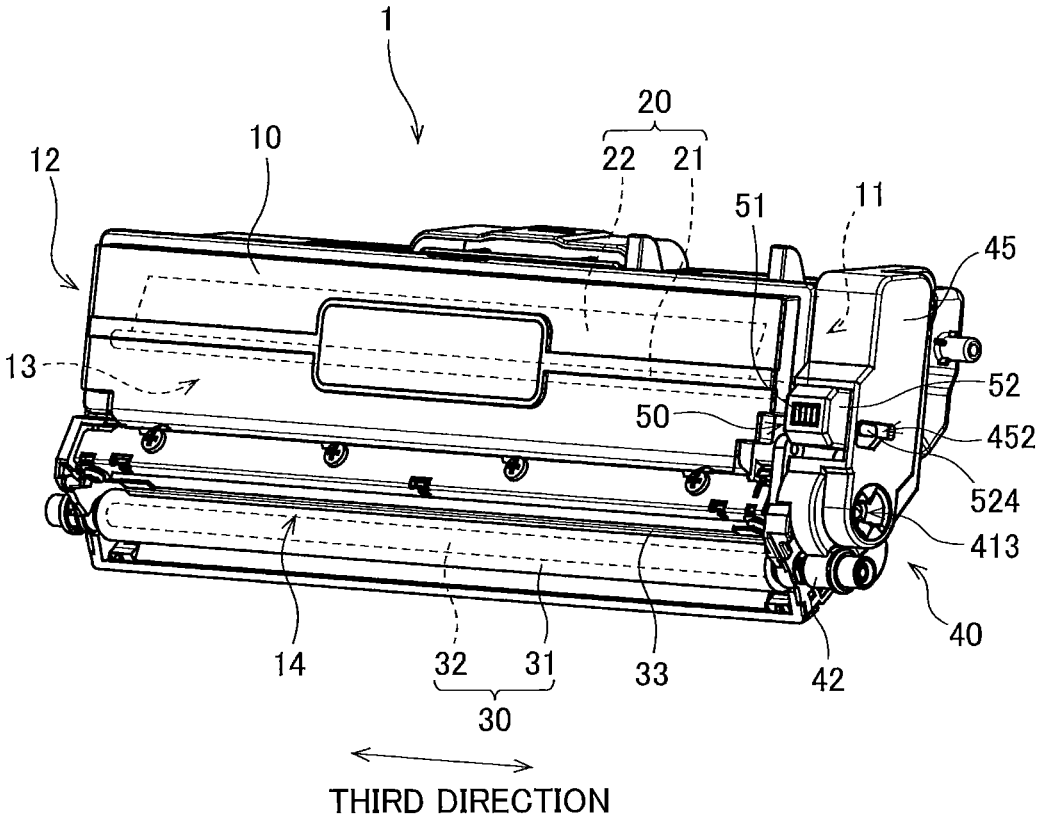
FIG. 1 is a perspective view of a developing cartridge according to one embodiment.
Figure 11:
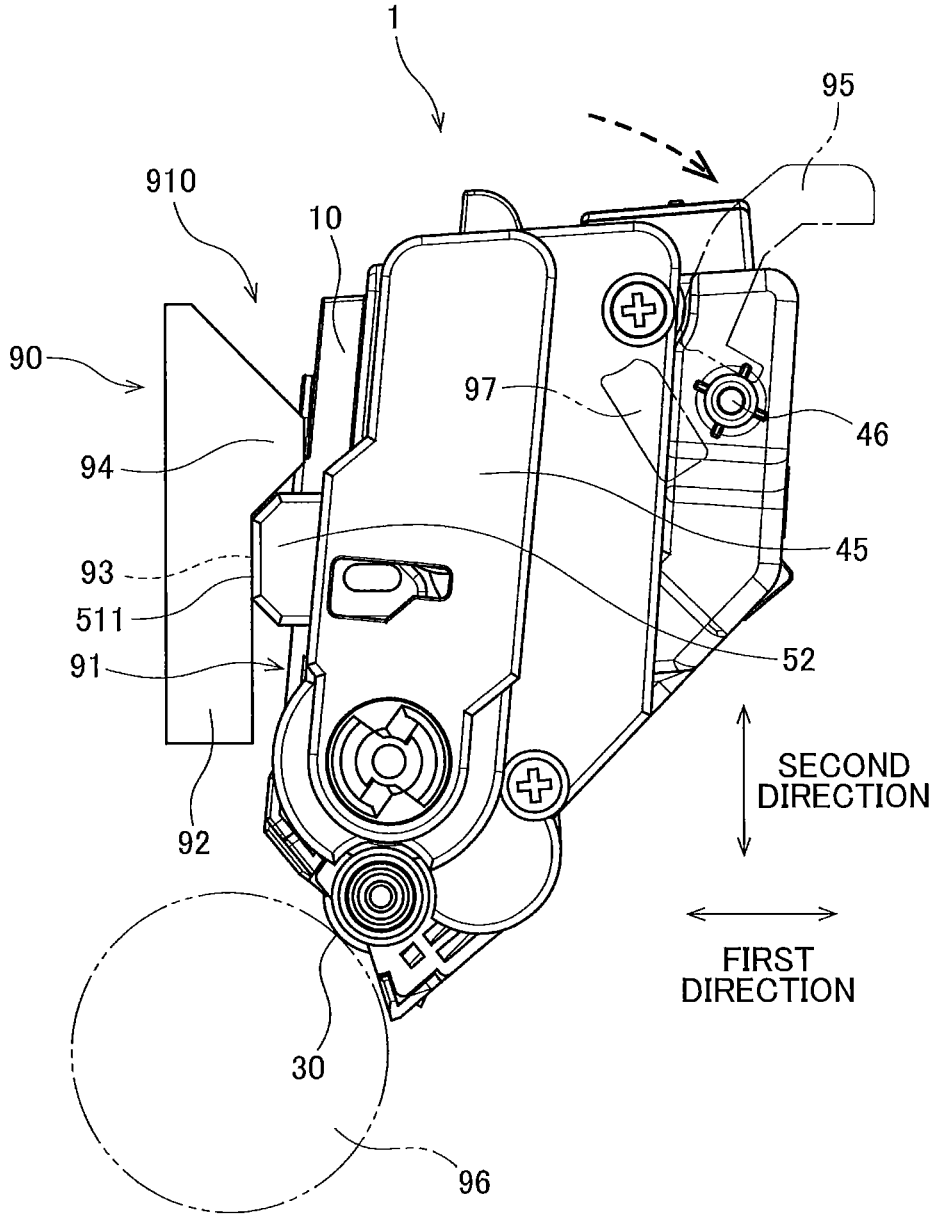
FIG. 11 is a view illustrating a state of inserting the developing cartridge according to the embodiment into the slot of the drawer unit after the state in FIG. 10.

A developing cartridge 1 illustrated in FIG. 1 is used for and electro-photographic type image forming apparatus such as a laser printer and an LED printer, and is configured to supply developing agent (for example, toner) to a photosensitive drum 96 (FIG. 11). The developing cartridge 1 is attachable to a drawer unit 90 (FIG. 8) provided at the image forming apparatus. For replacing the developing cartridge 1 with a new cartridge, the drawer unit is pulled out of a housing of the image forming apparatus. The drawer unit includes a plurality of slots into which equal plurality of developing cartridges can be inserted. A photosensitive drum is provided at each of the slots.

The developing cartridge 1 may be attached to the housing of the image forming apparatus. In this case, the developing cartridge 1 can be inserted in the corresponding slot among a plurality of slots formed in the image forming apparatus. A photosensitive drum is provided at each slot. Alternatively, the developing cartridge 1 may be attached to a drum unit attachable to a housing of the image forming apparatus. In the latter case, the drum unit includes a photosensitive drum. The drum unit to which the developing cartridge 1 is attached is inserted into a slot of the image forming apparatus.

As illustrated in FIG. 1, the developing cartridge 1 includes a casing 10, an agitator 20, a developing roller 30, a gear portion 40, and an IC chip assembly 50. The IC chip assembly 50 includes an IC chip 51 including an electric contact surface 511, and a pressure member 53. In the following description, a direction crossing the electric contact surface 511 will be referred to as "a first direction". Preferably, the first direction is perpendicular to the electric contact surface 511. Further, a moving direction of the pressure member 53 will be referred to as "a second direction". Incidentally, an inserting direction of the developing cartridge 1 into the drawer unit, or a moving direction of the casing 10 during detachment of the developing cartridge 1 will also be referred to as "the second direction". Further, an extending direction of a rotation axis of the developing roller 30 will be referred to as "a third direction". The first direction and the second direction cross to each other, and preferably perpendicular to each other. Further, the third direction and the first direction cross to each other, and preferably perpendicular to each other.

The casing 10 is a container configured to accommodate developing agent, and includes a first outer end surface 11 and a second outer end surface 12. The casing 10 extends in the third direction between the first outer end surface 11 and the second outer end surface 12. The gear portion 40 and the IC chip assembly 50 are positioned at the first outer end surface 11. An interior of the casing 10 includes an accommodation chamber 13 in which developing agent is accommodated. The casing 10 has an end portion in the inserting direction of the developing cartridge 1 with respect to the drawer unit, and an opening 14 is positioned at the end portion. The accommodation chamber 13 and an outside are communicated with each other through the opening 14.

The agitator 20 includes an agitator shaft 21 and an agitation blade 22. The agitator shaft 21 is rotatable about a rotation axis (second axis) extending in the third direction. The agitation blade 22 extends radially outward from the agitator shaft 21. At least a portion of the agitator shaft 21 and the agitation blade 22 are positioned in the accommodation chamber 13. The agitator shaft 21 has one end portion in the third direction to which an agitator gear 44 (described later) is fixed. Thus, the agitator shaft 21 and the agitation blade 22 are rotatable along with the rotation of the agitator gear 44. Rotation of the agitation blade 22 causes agitation of the developing agent in the accommodation chamber 13.

The developing roller 30 is rotatable about a rotation axis (first axis) extending in the third direction. The developing roller 30 is positioned to face the opening 14 of the casing 10. The developing roller 30 includes a roller body 31 and a developing roller shaft 32. The roller body 31 is a hollow cylindrical member extending in the third direction and is made from a material providing elasticity such as rubber. The developing roller shaft 32 is a solid cylindrical member extending through the roller body 31 in the third direction. The developing roller shaft 32 is made from metal or resin providing electrical conductivity. The roller body 31 is fixed to the developing roller shaft 32 so that relative rotation therebetween is prevented.

The developing roller shaft 32 has one end portion in the third direction to which a developing roller gear 42 (described later) is fixed. Particularly, the one end portion of the developing roller shaft 32 in the third direction is fixed to the developing roller gear 42 not to rotate with respect to the developing roller gear 42. Thus, rotation of the developing roller gear 42 causes rotation of the developing roller shaft 32 and the roller body 31.

Incidentally, the developing roller shaft 32 may not extend through the roller body 31 in the third direction. For example, each of a pair of developing roller shafts 32 extends in the third direction from each end of the roller body 31 in the third direction.

The developing cartridge 1 further includes a supply roller (not illustrated) positioned between the developing roller 30 and the accommodation chamber 13. The supply roller is rotatable about a rotation axis extending in the third direction. In a case where the developing cartridge 1 receives driving force, developing agent is supplied from the accommodation chamber 13 of the casing 10 to an outer peripheral surface of the developing roller 30 by way of the supply roller. In this instance, the developing agent is subjected to triboelectric charging between the supply roller and the developing roller 30. On the other hand, a bias voltage is applied to the developing roller shaft 32 of the developing roller 30. Accordingly, the developing agent is attracted to the outer peripheral surface of the roller body 31 by electrostatic force generated between the developing roller shaft 32 and the developing agent.

The developing cartridge 1 further includes a layer thickness regulation blade 33. The regulation blade 33 is configured to regulate a thickness of a layer of the developing agent supplied to the outer peripheral surface of the roller body 31. Then, the developing agent on the outer peripheral surface of the roller body 31 is supplied to the photosensitive drum provided at the drawer unit. In this case, the developing agent is moved from the roller body 31 to the photosensitive drum in accordance with an electrostatic latent image formed on an outer peripheral surface of the photosensitive drum. Thus, the electrostatic latent image becomes a visible image at the outer peripheral surface of the photosensitive drum.

Figure 2:
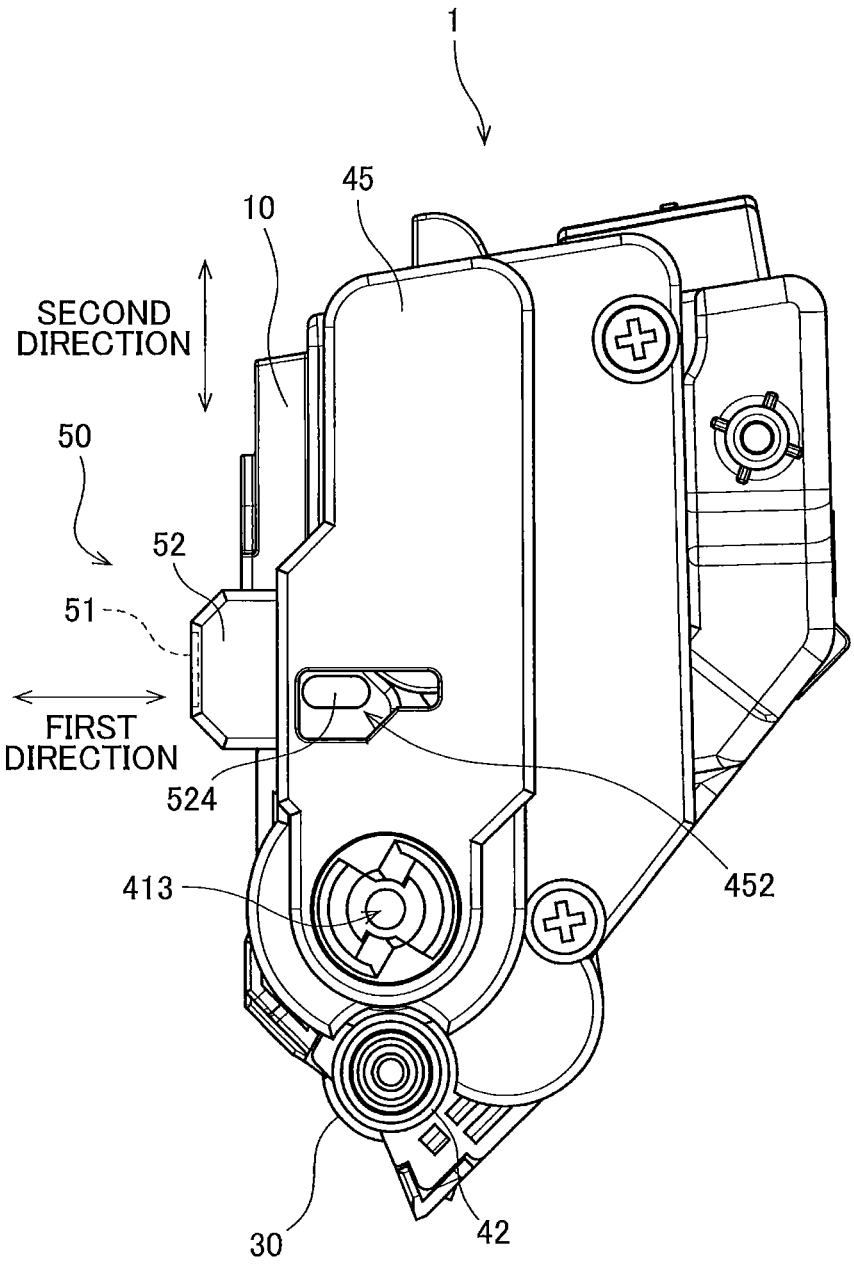
FIG. 2 is a side view of the developing cartridge according to the embodiment as viewed in a third direction.
Figure 3:
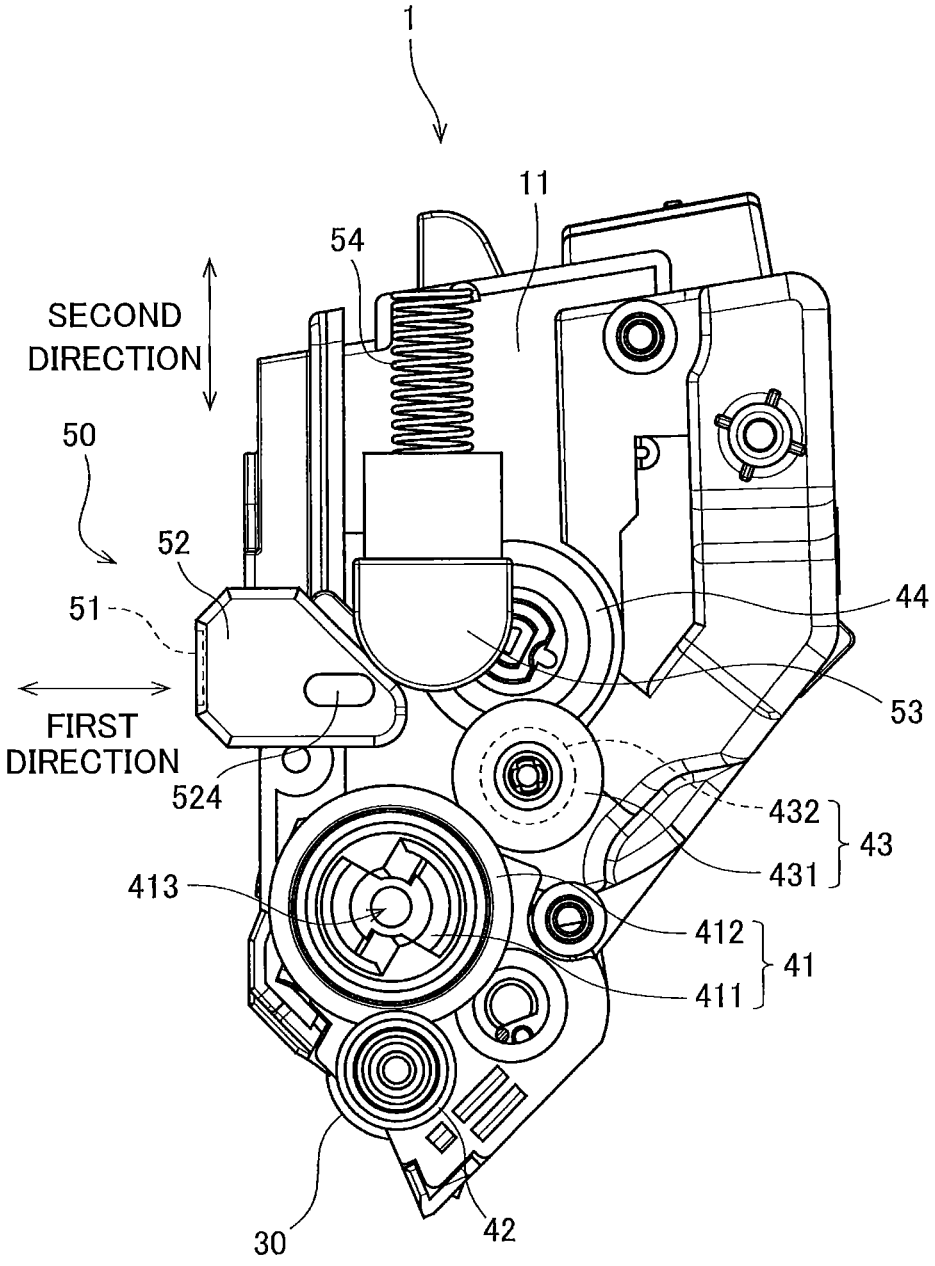
FIG. 3 is a side view of the developing cartridge according to the embodiment as viewed in a third direction and illustrating a state where a cover is removed.
Figure 4:
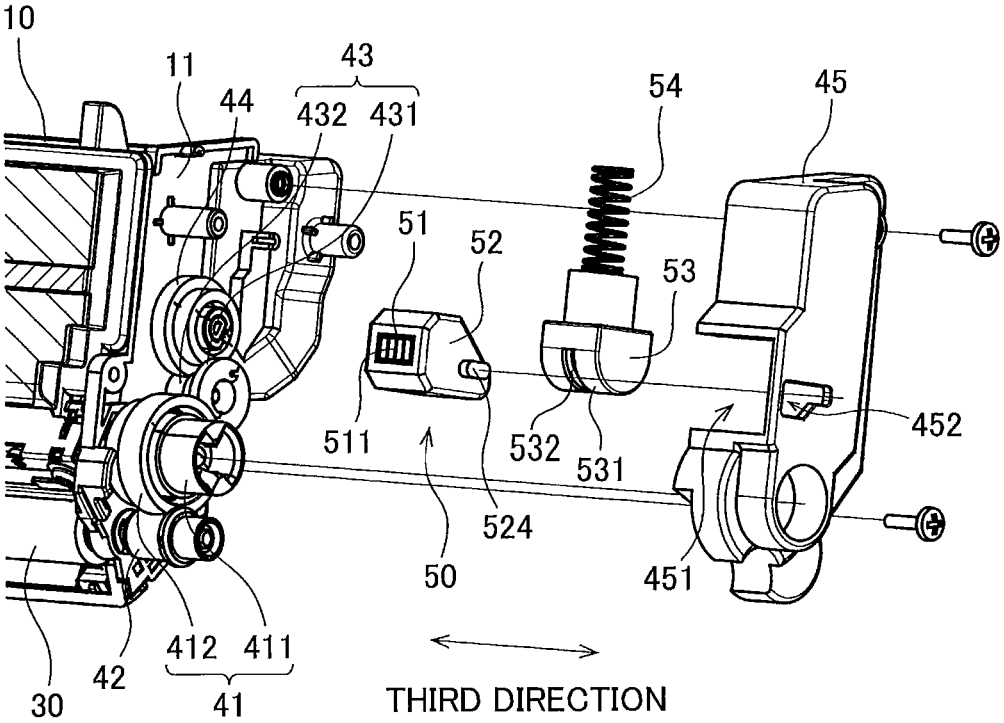
FIG. 4 is a partial exploded perspective view of the developing cartridge according to the embodiment.

As illustrated in FIGS. 2 through 4, the gear portion 40 is positioned at the first outer end surface 11 of the casing 10. The gear portion 40 includes a coupling 41, a developing roller gear 42, an idle gear 43, the agitator gear 44, and a cover 45. Incidentally, a plurality of gear teeth of these gears is omitted in FIGS. 3 and 4.

The coupling 41 is configured to firstly receive driving force supplied from the image forming apparatus, and is rotatable about a rotation axis extending in the third direction. The coupling 41 includes a coupling portion 411 and a coupling gear 412. The coupling portion 411 and the coupling gear 412 are formed integrally therewith with resin, for example. The coupling portion 411 has a fixing hole 413 dented in the third direction. An entire outer peripheral surface of the coupling gear 412 includes with a plurality of gear teeth spaced away from each other at a constant interval in a circumferential direction.

In a care where the drawer unit to which the developing cartridge 1 is attached is inserted into the image forming apparatus, a drive shaft (not illustrated) of the image forming apparatus is inserted into the fixing hole 413 of the coupling portion 411. Thus the drive shaft and the coupling portion 411 are connected together disabling relative rotation therebetween. Accordingly, upon rotation of the drive shaft, the coupling portion 411 is rotated, so that the coupling gear 412 is also rotated.

The developing roller gear 42 is for rotating the developing roller 30, and is rotatable about a rotation axis extending in the third direction. An entire outer peripheral surface of the developing roller gear 42 includes a plurality of gear teeth spaced away from each other at a constant interval in a circumferential direction of the developing roller gear 42. A gear tooth of the coupling gear 412 is in meshing engagement with a gear tooth of the developing roller gear 42. The developing roller gear 42 is fixed to one end portion of the developing roller shaft 32 in the third direction not to rotate with respect to the one end portion of the developing roller shaft 32. Therefore, upon rotation of the coupling gear 412, the developing roller gear 42 is rotated to rotate the developing roller 30.

The idle gear 43 is configured to transmit rotation of the coupling gear 412 to the agitator gear 44. The idle gear 43 is rotatable about a rotation axis extending in the third direction, and includes a large diameter gear portion 431 and a small diameter gear portion 432, and the large diameter gear portion 431 and the small diameter gear portion 432 are aligned in the third direction. The small diameter gear portion 432 is positioned between the large diameter gear portion 431 and the first outer end surface 11 of the casing 10. In other words, the large diameter gear portion 431 is positioned farther from the first outer end surface 11 than the small diameter gear portion 432 is from the first outer end surface 11. A diameter of an addendum circle of the small diameter gear portion 432 is smaller than a diameter of an addendum circle of the large diameter gear portion 431. The large diameter gear portion 431 and the small diameter gear portion 432 are integrally formed with each other with resin.

Entire outer peripheral surfaces of the large diameter gear portion 431 and the small diameter gear portion 432 include a plurality of gear teeth spaced away from each other at a constant interval in a circumferential direction, respectively. The numbers of gear teeth of the small diameter gear portion 432 is smaller than the numbers of gear teeth of the large diameter gear portion 431. A gear tooth of the coupling gear 412 and a gear tooth of the large diameter gear portion 431 are in meshing engagement with each other. Further, a gear tooth of the small diameter gear portion 432 and a gear tooth of the agitator gear 44 are in meshing engagement with each other. Upon rotation of the coupling gear 412, the large diameter gear portion 431 is rotated so that rotation of the small diameter gear portion 432 causes the agitator gear 44 to rotate.

The agitator gear 44 is for rotating the agitator 20 provided in the accommodation chamber 13, and is rotatable about a rotation axis extending in the third direction. An entire outer peripheral surface of the agitator gear 44 includes a plurality of gear teeth spaced away from each other at a constant interval in a circumferential direction. As described above, the gear tooth of the small diameter gear portion 432 and the gear tooth of the agitator gear 44 are in meshing engagement with each other, and further, the agitator gear 44 is fixed to the one end portion of the agitator shaft 21 in the third direction so as not to be rotatable relative to the agitator shaft 21. Therefore, upon power transmission to the agitator gear 44 from the coupling 41 through the idle gear 43, the agitator gear 44 is rotated, causing the agitator 20 to rotate.

Figure 5:
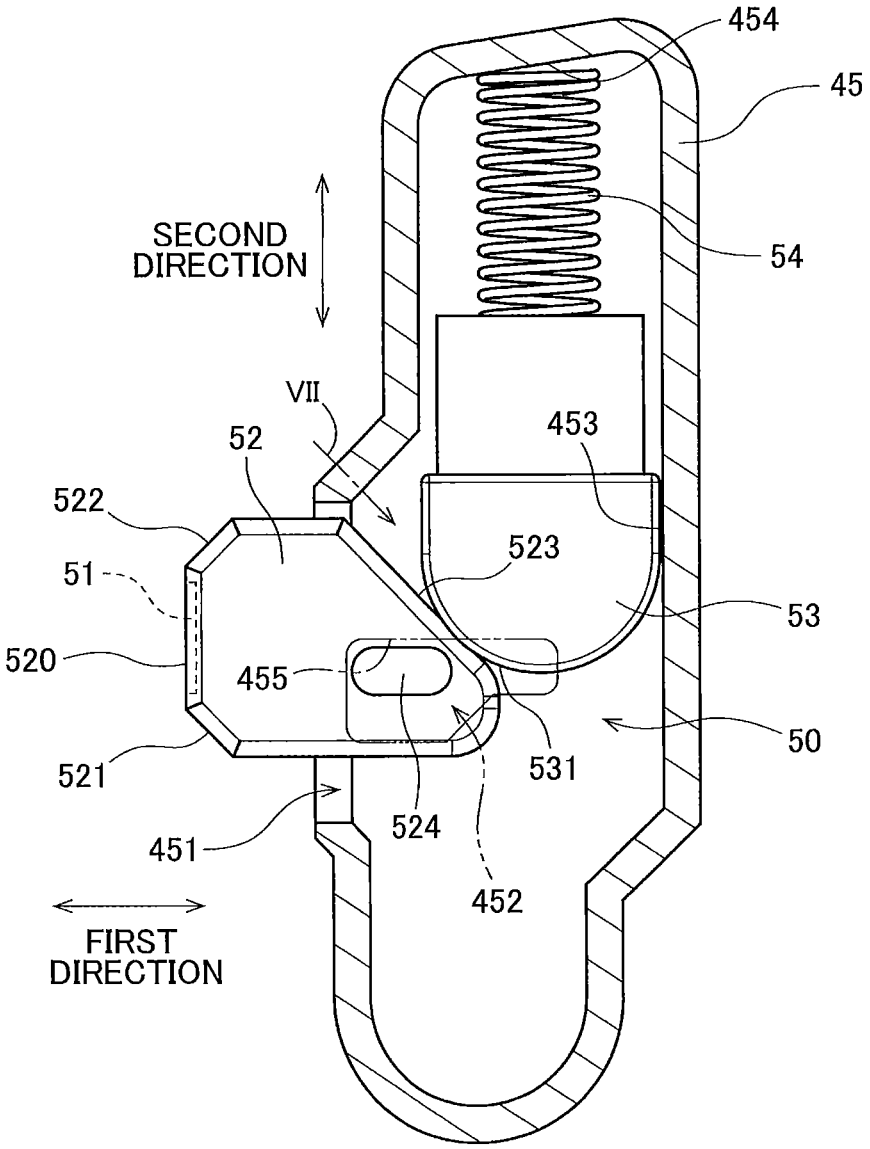
FIG. 5 is a side view of an IC chip assembly in the developing cartridge according to the embodiment as viewed in the third direction.

The cover 45 is fixed to the first outer end surface 11 by, for example, screws. The coupling gear 412, the developing roller gear 42, the idle gear 43, and the agitator gear 44 are accommodated in a space defined by the first outer end surface 11 and the cover 45. The fixing hole 413 of the coupling portion 411 is exposed to the outside of the cover 45. The cover 45 also serves as a holder casing for holding a holder 52 (described later) of the IC chip assembly 50. The cover 45 has an opening portion 451. Further, a through-hole 452 extends through the cover 45 in the third direction. The cover 45 includes a first guide surface 453, and an attachment surface 454 described later. A portion of an inner peripheral portion of the through-hole 452 of the cover 45 functions as a second guide surface 455 extending in the first direction (FIG. 5). The cover 45 includes a columnar protrusion 46 (FIG. 11).

3. IC Chip Assembly

As illustrated in FIG. 4, the IC chip assembly 50 is positioned at a position between the cover 45 and the first outer end surface 11 of the casing 10. As illustrated in FIGS. 3 through 6, the IC chip assembly 50 includes the IC chip 51 as a storage medium, the holder 52 holding the IC chip 51, the pressure member 53, and a coil spring 54.

Figure 6:
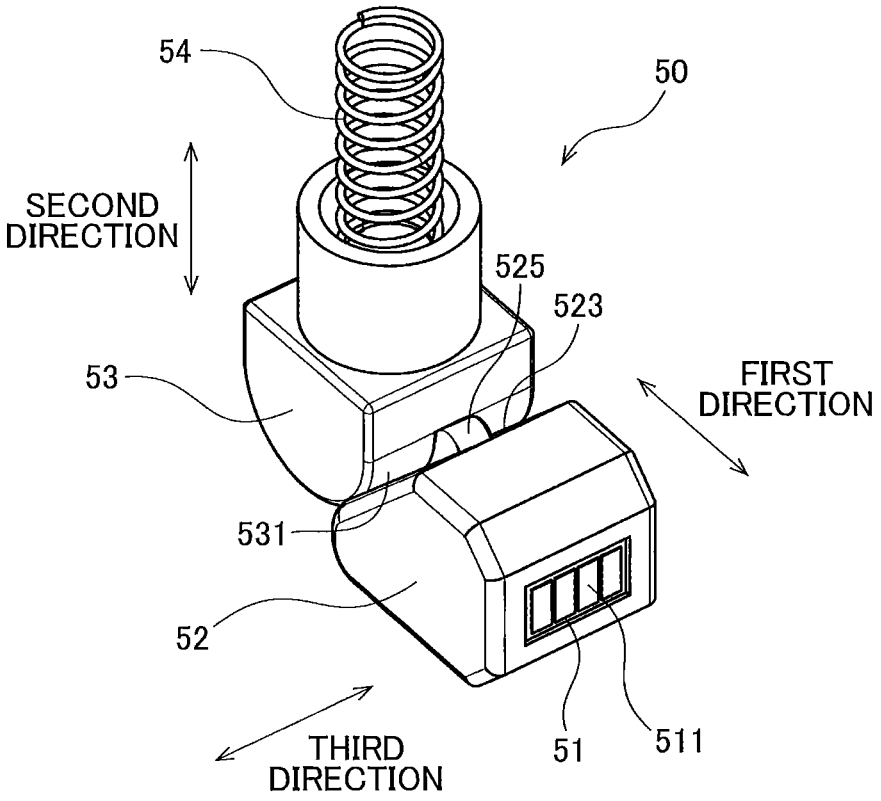
FIG. 6 is a perspective view of the IC chip assembly in the developing cartridge according to the embodiment.

The IC chip 51 is fixed to an end surface in the first direction of the holder 52. The IC chip 51 is configured to store various information as to the developing cartridge 1. As illustrated in FIGS. 4 and 6, the IC chip 51 includes the electric contact surface 511 made from electrically conductive material such as metal. On the other hand, the drawer unit includes a terminal portion. The electric contact surface 511 of the IC chip 51 is brought into contact with the terminal portion as a result of attachment of the developing cartridge 1 to the drawer unit. Thus, the electric contact surface 511 and the terminal portion are electrically connected to each other. Accordingly, the image forming apparatus can perform at least one of reading information from the IC chip 51 and writing information into the IC chip 51.

The holder 52 is held between the casing 10 and the cover 45. At least a portion of the holder 52 is covered by the cover 45. The holder 52 extends through the opening 451 of the cover 45 such that a portion of the holder 52 is positioned inside the cover 45, and a remaining portion of the holder 52 is positioned outside of the cover 45.

The holder includes has a boss 524. The boss 524 protrudes in the third direction toward the cover 45 from a surface of the holder 52 which faces the cover 45. The boss 524 has solid cylindrical shape or prismatic columnar shape or other shape. The boss 524 is inserted in to the through-hole 452 of the cover 45 in the third direction.

The through-hole 452 has a dimension (inner dimension) in the first direction greater than a dimension (outer dimension) in the first direction of the boss 524. Therefore, the holder 52 is movable together with the boss 524 in the first direction relative to the casing 10 and the cover 45. The IC chip 51 including the electric contact surface 511 is also movable in the first direction along with the holder 52 in accordance with the movement of the holder 52 in the first direction.

Further, the through-hole 452 has a dimension (inner dimension) in the second direction greater than a dimension (outer dimension) in the second direction of the boss 524. Therefore, the holder 52 is movable along with the boss 524 in the second direction relative to the casing 10 and the cover 45. The IC chip 51 including the electric contact surface 511 is also movable in the second direction along with the holder 52 in accordance with the movement of the holder 52 in the second direction.

Incidentally, the holder 52 may include a plurality of bosses. In the latter case, the cover 45 may have one through-hole or a plurality of through-holes for allowing the plurality of bosses to be inserted therethrough. Further, the cover 45 may include recessed portion(s) instead of the through-hole(s) for allowing the boss(es) to be inserted thereinto. Further, the holder 52 may include a boss protruding toward the first outer surface 11 of the casing 10. In this case, the casing 10 may have a recessed portion for allowing the boss to be inserted thereinto. Further, the holder 52 may be movable in the third direction at a position between the first outer surface 11 of the casing 10 and the cover 45.

The holder 52 has one end and another end in the first direction. As illustrated in FIG. 5, the one end of the holder 52 includes a hold surface 520, a first surface 521, and a second surface 522, and these surfaces 520, 521, 522 are positioned outside of the cover 45 relative to the opening 451. The IC chip 51 is held by the hold surface 520. The first surface 521 is positioned closer to the developing roller 30 than the hold surface 520 is to the developing roller 30. The first surface 521 is sloped with respect to the hold surface 520 such that the first surface 521 approaches the pressure member 53 in the first direction with the increasing distance from the hold surface 520. The second surface 522 is positioned farther from the developing roller 30 than the hold surface 520 is from the developing roller 30. The second surface 522 is sloped with respect to the hold surface 520 such that the second surface 522 approaches the pressure member 52 with the increasing distance from the hold surface 520.

Incidentally, the first surface 521 and the second surface 522 may be flat surfaces or curved surfaces. These surfaces 521, 522 are preferably smooth surfaces without any stepped portion so as to facilitate insertion of the developing cartridge 1 to the drawer unit without any dragging.

The other end of the holder 52 in the first direction has a first inclination surface 523 positioned inside of the cover 45 relative to the opening 451. The first surface 521 is positioned opposite to the hold surface 520, the first surface 521, and the second surface 522 in the first direction. In this embodiment, the first inclination surface 523 is a flat surface extending in the third direction, and is inclined with respect to the first and second directions. More specifically, the first inclination surface 523 is inclined such that the first inclination surface 523 is gradually distant from the electric contact surface 511 with the decreasing distance from the developing roller 30. The holder 52 further includes a guide protrusion 525 described later and illustrated in FIGS. 6 and 7.

The pressure member 53 is in contact with the holder 52 and is configured to move the holder 52 in the first direction. The pressure member 53 is positioned between the first outer surface 11 and the cover 45 in the third direction. As illustrated in FIG. 5, the cover 45 includes the first guide surface 453. The first guide surface 453 of the cover 45 is a portion of an inner surface of the cover 45 covering the pressure member 53 and the coil spring 54. The first guide surface 453 is positioned opposite to the holder 52 with respect to the pressure member 53 in the first direction. The first guide surface 453 extends in the second direction along the pressure member 53 and the coil spring 54. The pressure member 53 is movable in the second direction while being guided by the first guide surface 453.

The pressure member 53 includes a pressure surface 531 facing the holder 52. In this embodiment, the pressure surface 531 is arcuate in shape whose center of radius of curvature extends in the third direction. The pressure surface 531 is in contact with the first inclination surface 523 of the holder 52. More specifically, a line contact is provided between a portion of the pressure surface 531 and a portion of the first inclination surface 523. The line contact between the pressure surface 531 and the inclination surface 523 can reduce friction therebetween in comparison with a surface contact therebetween. Alternatively, the pressure surface 531 may have a convex shape. Incidentally, the holder 52 may have an arcuate surface whose center of radius extends in the third direction or a convex surface in shape, and such arcuate surface or convex surface may be in contact with the pressure member 53.

Figure 7:
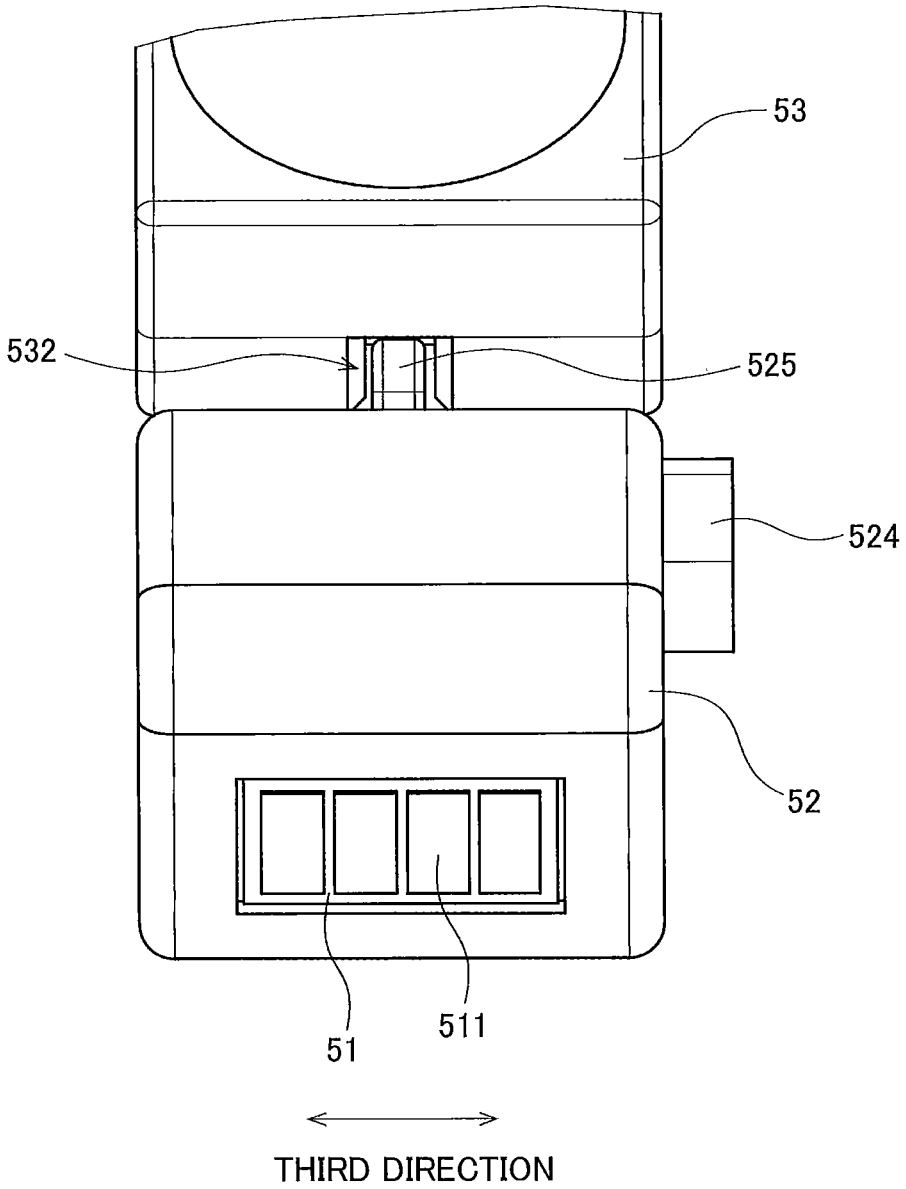
FIG. 7 illustrates a holder and a pressure member as viewed in a direction indicated by a dotted chain line arrow VII of FIG. 5 in the developing cartridge according to the embodiment.
Figure 8:
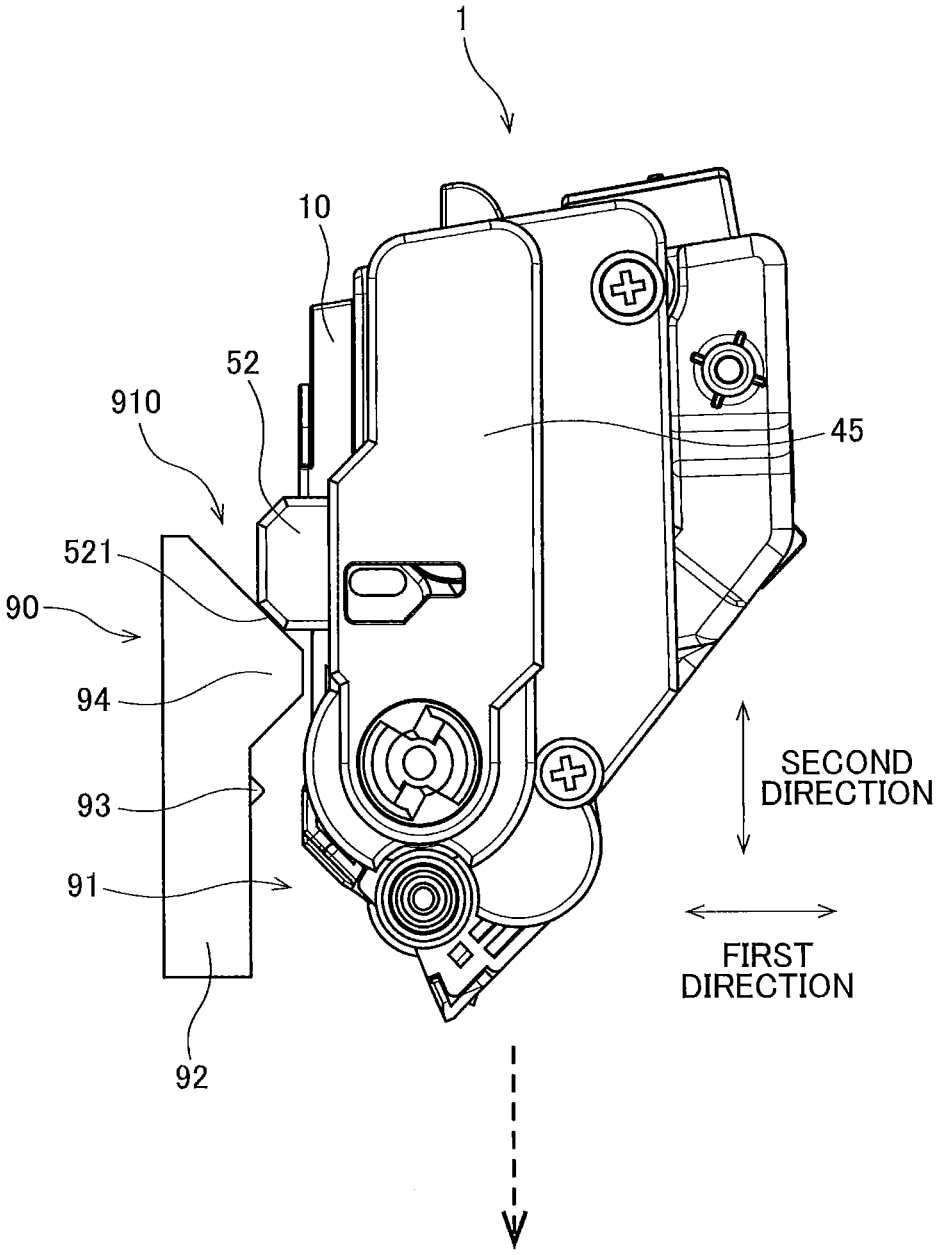
FIG. 8 is a view illustrating an initial state of inserting the developing cartridge according to the embodiment into a slot of a drawer unit.

Further, the pressure surface 531 of the pressure member 53 includes a guide groove 532 as illustrated in FIG. 7. The guide groove 532 is recessed inward of the pressure member 53 from the pressure surface 531. The guide groove 532 extends along the pressure surface 531 in a direction perpendicular to the third direction.

The coil spring 54 extends in the second direction and is a resiliently deformable or elastic member. The coil spring 54 is positioned between the first outer surface 11 of the casing 10 and the cover 45 covering the pressure member 53 and the coil spring 54. As illustrated in FIG. 5, the attachment surface 454 of the cover 45 is a portion of the inner surface of the cover 45, and is positioned opposite to the pressure member 53 with respect to the coil spring 54 in the second direction. The attachment surface 454 extends in the first direction. The coil spring 54 has one end in the second direction seated on the attachment surface 454, and another end portion in the second direction seated on the pressure member 53.

The coil spring 54 is extendable and shrinkable in the second direction between a first state and a second state providing higher shrinkage than the first state. A length between one end and another end of the coil spring 54 in the second direction in the first state is greater than a length between the one end and the another end of the coil spring 54 in the second direction in the second state. Further, the length of the coil spring 54 in the second direction in the first state and the length of the coil spring 54 in the second direction the second state are smaller than a natural length of the coil spring 54. Therefore, urging force of the coil spring 54 in the second direction is always applied to the pressure member 53. That is, the coil spring 54 is an urging member for urging the pressure member 53 in a direction away from the attachment surface 454.

The force directing in the second direction and applied to the pressure member 53 is converted in to a force directing in the first direction by the contact between the pressure surface 531 and the first inclination surface 523. Therefore, the holder 52 receives the elastic force directing in the first direction from the pressure member 53. That is, the holder 52 is urged in a direction away from the first guide surface 453. The holder 52 is positioned at the first position in a case where the coil spring 54 is at the first state, and the holder 52 is positioned at the second position closer to the first guide surface 453 than the holder 52 at the first position is to the first guide surface 453 in a case where the coil spring 54 is at the second state. In other words, a distance between the electric contact surface 511 and the pressure member 53 in the first direction in a case where the holder is at the first position is greater than another distance between the electric contact surface 511 and the pressure member 53 in the first direction in a case where the holder is at the second position.

In a case where the holder 52 is moved in the first direction, the boss 524 is moved in the first direction along the second guide surface 455 of the through-hole 452 of the cover 45 (FIG. 5). Thus, stabilized movement of the holder 52 can be obtained. Incidentally, the cover 45 may include a second guide surface for guiding the holder 52 in the first direction at a position other than the portion of the peripheral surface of the through-hole 452.

Further, the pressure member 53 is nipped or interposed between the holder 52 and the first guide surface 453 at least in a case where the coil spring 54 is at the first state. Thus, the pressure member 53 presses the holder 52 in the first direction while the pressure member 53 is supported by the first guide surface 453. Accordingly, the pressing force in the first direction applied to the holder 52 from the pressure member 53 can be increased in comparison with a case where the first guide surface 453 were not provided.

As illustrated in FIGS. 6 and 7, the holder 52 includes the guide protrusion 525. The guide protrusion 525 of the holder 52 protrudes from the first inclination surface 523 toward the pressure member 53. Further, the guide protrusion 525 extends along the first inclination surface 523 in a direction perpendicular to the third direction. The guide protrusion 525 is accommodated in the guide groove 532 of the pressure member 53. The guide protrusion 525 is moved along the guide groove 532 in a case where the coil spring 54 is expanded or shrunk between the first state and the second state. Because of the engagement between the guide protrusion 525 and the guide groove 532, displacement between the holder 52 and the pressure member 53 in the third direction can be restrained. As a result, a stabilized pressing force can be transmitted from the pressure member 53 to the holder 52.

Incidentally, the pressure member 53 may include a guide protrusion, and the holder 52 may include a guide groove, so that the guide protrusion of the pressure member 53 is engaged with the guide groove of the holder 52.

3. Attaching Operation in Re Developing Cartridge

Next operation for attachment of the developing cartridge 1 to the drawer unit 90 will be described with reference to FIGS. 8 through 11. In these drawings, attachment states of one developing cartridge 1 to one slot 91 formed in the drawer unit 90 are illustrated.

For inserting the developing cartridge 1 into the slot 91, the developing cartridge 1 is positioned to face an insertion open end 910 of the slot 91. In this case, the holder 52 has not yet contacted with the drawer unit 90. Therefore, the coil spring 54 is at the first state. Further, the holder 52 is at the first position in the first direction. The developing cartridge 1 will be inserted into the slot 91 in the second direction as indicated by a broken line arrow in FIG. 8.

Figure 12:
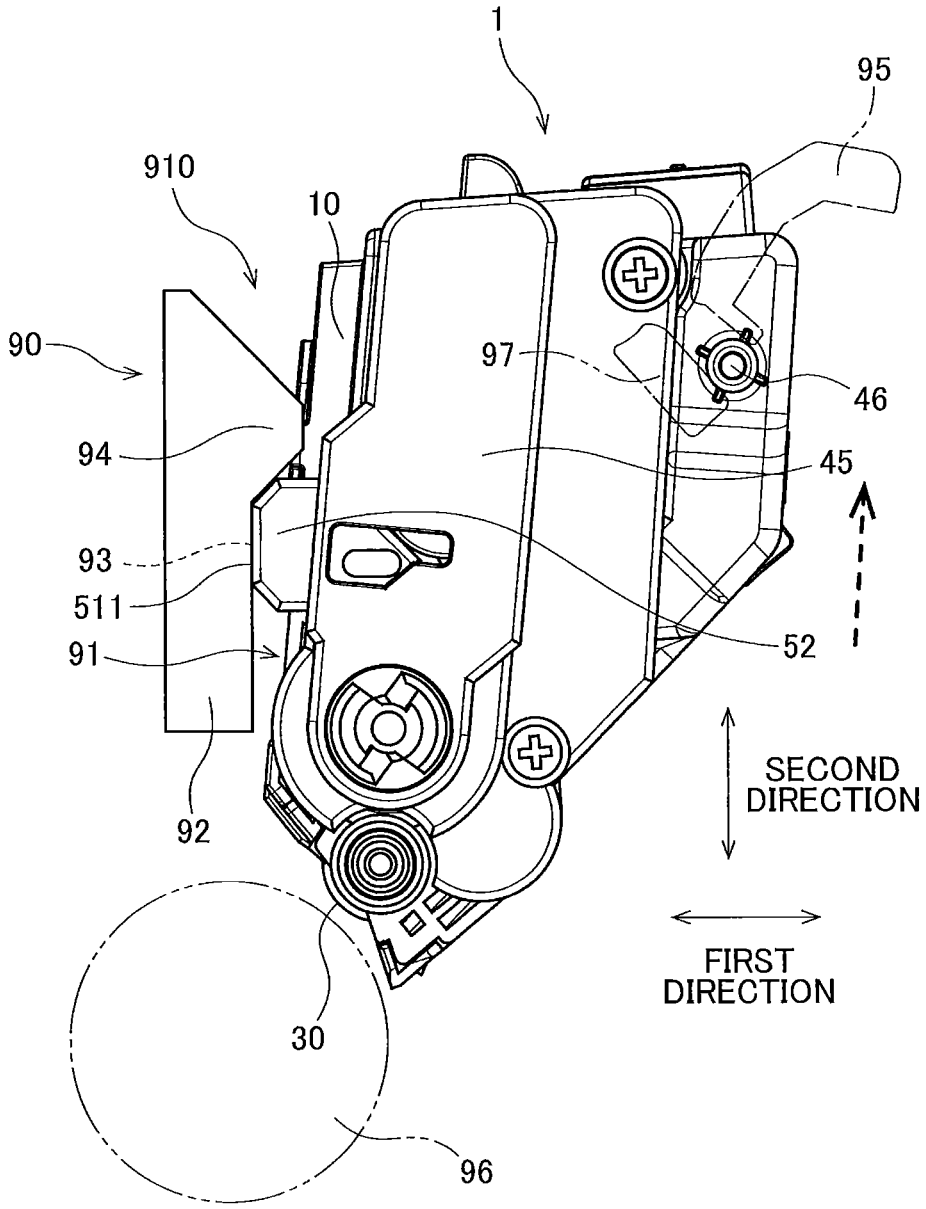
FIG. 12 is a view for description of detachment of the developing cartridge according to the embodiment from the slot.

Each slot 91 of the drawer unit 90 includes a guide plate 92 as illustrated in FIGS. 8 through 11. Each guide plate 92 extends in the second and the third directions. Each guide plate 92 includes a terminal portion 93 which is an electrical contact contactable with the electric contact surface 511 of the IC chip 51. The terminal portion 93 is provided at a surface of the guide plate 92 and extends inward of each slot 91. The terminal portion 93 is made from electrically conductive material such as metal. The guide plate 92 also includes a projection 94 positioned closer to the insertion open end 910 than the terminal portion 93 is to the insertion open end 910. The projection 94 protrudes inward the slot 91 from the guide plate 92. The drawer unit 90 also includes a pressing member 95 (FIG. 11), and a separation lever 97 (FIG. 12).

During insertion of the developing cartridge 1 into the slot 91, the first surface 521 of the holder 52 is brought into contact with the projection 94 of the guide plate 92, and the holder 52 is moved in the first direction because the first surface 521 is pressed by the projection 94. That is, the holder 52 is moved from the first position to the second position in the first direction. Accordingly, the pressure member 63 is moved in the second direction toward the attachment surface 454 of the cover 45, and the coil spring 54 is compressed from the first state to the second state.

Figure 9:
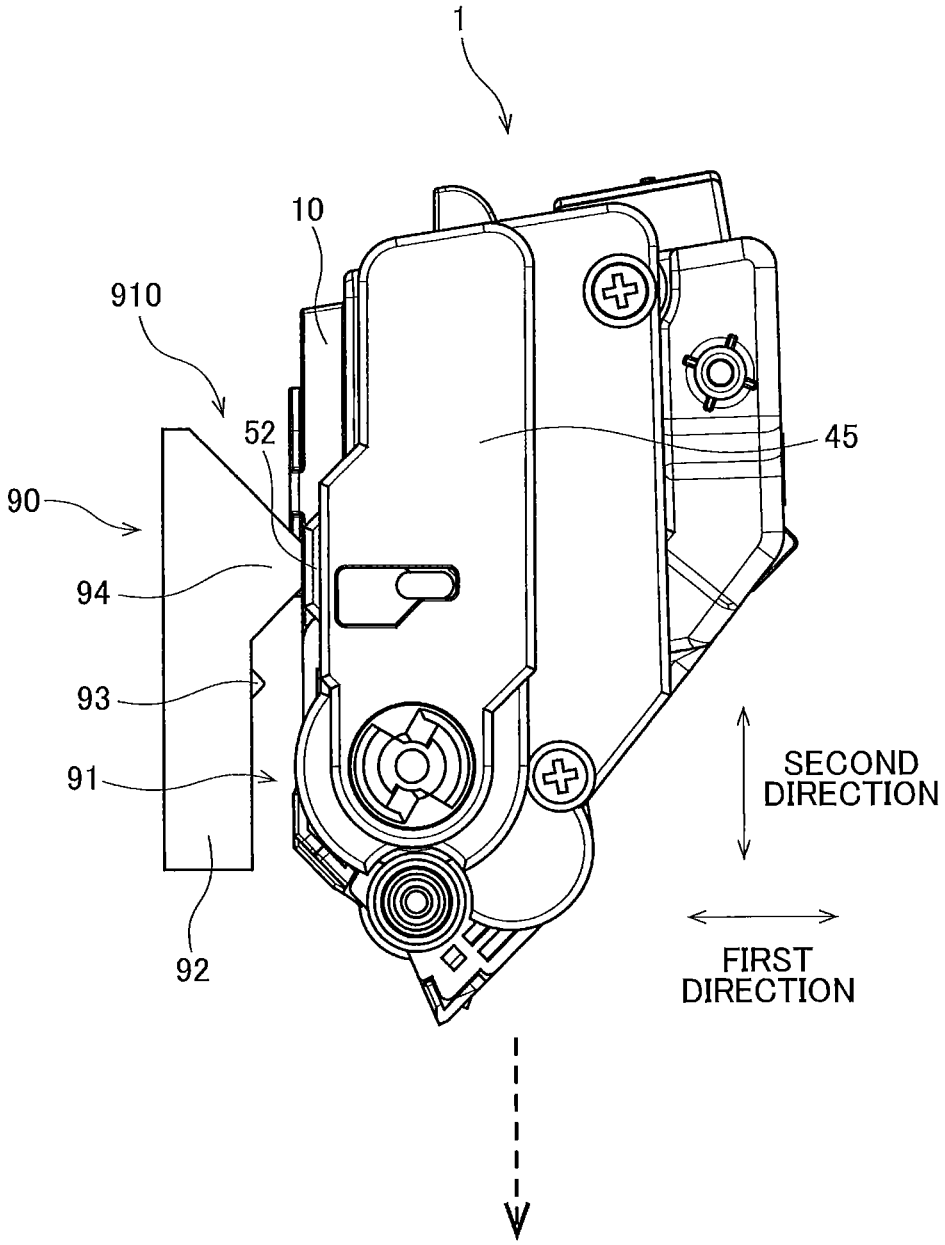
FIG. 9 is a view illustrating a state of inserting the developing cartridge according to the embodiment into the slot of the drawer unit after the state in FIG. 8.

Thereafter, the holder 52 approaches the first guide surface 453 of the cover 45 in a case where the holder 52 is brought into contact with an apex portion of the projection 94 as illustrated in FIG. 9. That is, the holder 52 is positioned at the second position in the first direction, and the coil spring 54 becomes the second state. Here, the length of the coil spring 54 in the second direction becomes shorter than the length of the coil spring 54 that in the first state and in a third state described later.

In this way, in the IC chip assembly 50, the positions of the holder 52 and the IC chip 51 relative to the cover 45 can be changed in the first direction. Therefore, insertion of the developing cartridge 1 can be performed while changing the position of the electric contact surface 511 in the first direction along the profile of the projection 94. Consequently, the developing cartridge 1 can be inserted with reducing frictional wearing of the electric contact surface 511 relative to the terminal portion 93.

Figure 10:
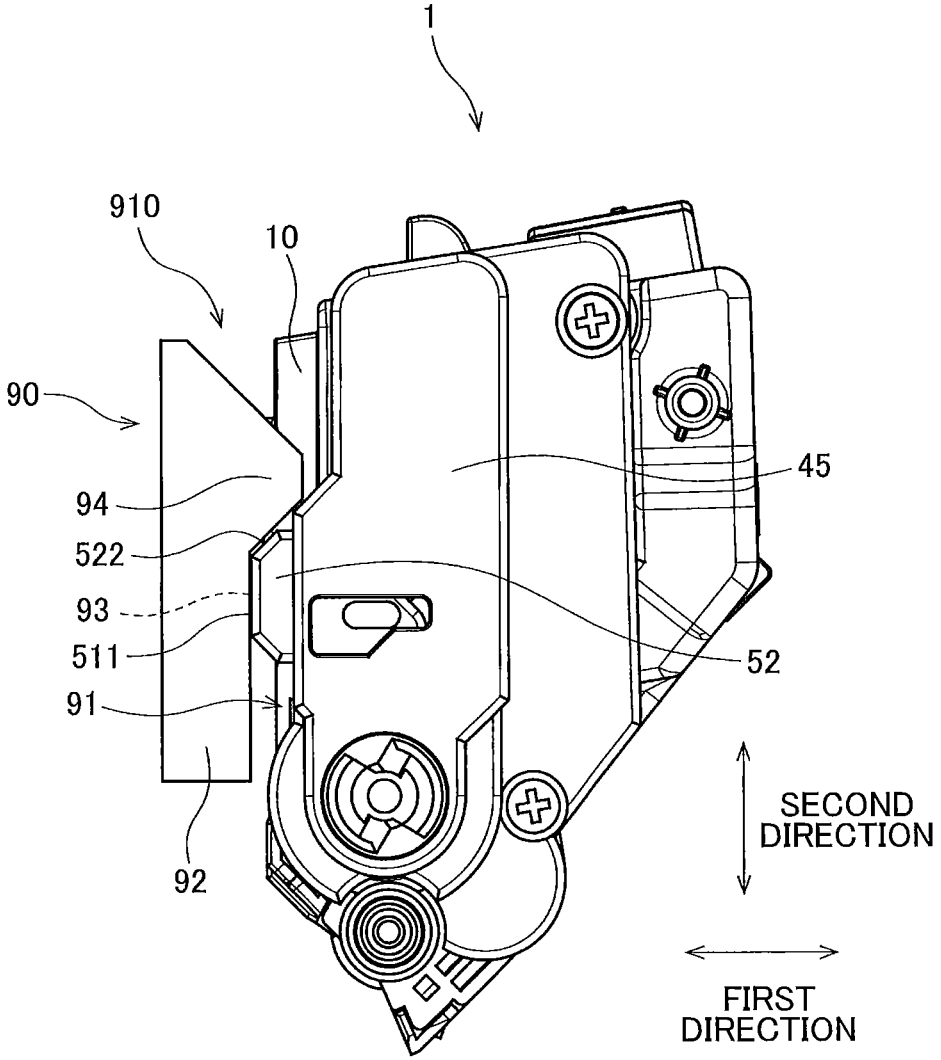
FIG. 10 is a view illustrating a state of inserting the developing cartridge according to the embodiment into the slot of the drawer unit after the state in FIG. 9.

Thereafter, by further inserting the developing cartridge 1 in the second direction, the second surface 522 of the holder 52 is moved past the projection 94. In accordance with the movement, the coil spring 54 is again expanded from the second state and becomes an intermediate state (third state). A length of the coil spring 54 at the intermediate state is smaller than a length of the coil spring 54 at the first state and greater than a length of the coil spring 54 at the second state. Further, the holder 52 is positioned at a third position in the first direction between the first position and the second position. As a result, the electric contact surface 511 of the IC chip 51 is brought into contact with the terminal portion 93 as illustrated in FIG. 10. In this state, a controller of the image forming apparatus can perform at least one of reading information from the IC chip 51 and writing information into the IC chip 51.

Assuming that the electric contact surface 511 contacts the terminal portion 93 while the electric contact surface 511 is moving in the second direction, the electric contact surface 511 is moved in the second direction in sliding contact with the terminal portion 93. In such a case, frictional wearing may occur at the electric contact surface 511 and the terminal portion 93. On the contrary, in the structure according to this embodiment, the electric contact surface 511 is brought into contact with the terminal portion 93 immediately after the holder 52 moves past the protrusion 94. Accordingly, contacting position of the terminal portion 93 relative to the electric contact surface 511 is not changed easily after the contact therebetween. Consequently, frictional wearing of the electric contact surface 511 can further be reduced.

In the state illustrated in FIG. 10, the length of the coil spring 54 in the second direction is smaller than a natural length of the coil spring 54. Therefore, the electric contact surface 511 is urged against the terminal portion 93 by the elastic force (repelling force) of the coil spring 54. Accordingly, desirable contact between the electric contact surface 511 and the terminal portion 93 can be maintained.

As illustrated in FIG. 11, the casing 10 is tilted in the first direction as indicated by a broken line arrow in a case where the casing 10 is further pressed after the electric contact surface 511 contacts the terminal portion 93. In this case, the columnar protrusion 46 of the cover 45 is brought into contact with the pressing member 95 of the drawer unit 90. The pressing member 95 presses the columnar protrusion 46 toward the photosensitive drum 96. As a result, the developing roller 30 is pressed against the photosensitive drum 96. That is, the developing roller 30 and the photosensitive drum 96 are maintained in contacting state contacting with each other.

The posture of the pressure member 53 with respect to the holder 52 is changed in accordance with the operation indicated by the broken line arrow in FIG. 11. However, in this embodiment, a portion of the arcuate pressure surface 531 and the first inclination surface 523 of the holder 52 are in contact with each other. Therefore, another portion of the pressure surface 531 of the pressure member 53 is brought into contact with the first inclination surface 523 even if the posture of the pressure member 53 relative to the holder 52 is changed. Consequently, a contacting state between the holder 52 and the pressure member 53 can be easily maintained.

4. Separating Operation

In the image forming apparatus, separating operation can be performed for temporarily separating the developing roller 30 from the photosensitive drum 96 after attachment of the developing cartridge 1.

In the separating operation, a lever (not shown) of the drawer unit 90 is pushed by a driving force from the image forming apparatus, so that the separation member 97 of the drawer unit 90 is moved in the second direction toward the pressing member 95 as illustrated in FIG. 12. As a result, the separation member 97 is brought into contact with the columnar protrusion 46 to press the columnar protrusion 46 in a direction away from the photosensitive drum 96 against the pressing force from the pressing member 95. Consequently, the casing 10, the developing roller 30, and the cover 45 of the developing cartridge 1 are moved in the second direction as indicated by a broken line arrow in FIG. 12. Thus, the developing roller 30 and the photosensitive drum 96 are at the separating state in which the developing roller 30 and the photosensitive drum 96 are separated from each other.

The position of the terminal portion 93 is unchanged not only in the contacting state (FIG. 11) prior to separating operation but also in the separating state (FIG. 12) after separating operation. Further, the position of the pressure member 53 can be maintained at a constant position by the elastic deformation of the coil spring 54. Therefore, the holder 52 is maintained in the nipped state where the holder 52 is nipped between the terminal portion 93 and the pressure member 53 not only in the contacting state but also in the separating state. Accordingly, the electric contact surface 511 is maintained in the state where the electric contact surface 511 is in contact with the terminal portion 93. In this way, the casing 10 and the cover 45 are moved with respect to the holder 52 without changing the position of the holder 52 in the separating operation.

That is, the casing 10, the developing roller 30 and the cover 45 are moved in the second direction during the separating operation whereas the position of the holder 52 relative to the drawer unit 90 is unchanged. In other words, the position of the casing 10 in the second direction is changed while the position of the electric contact surface 511 with respect to the drawer unit 90 is fixed. Accordingly, the contacting state between the electric contact surface 511 and the terminal portion 93 can be maintained. Further, frictional wearing of the electric contact surface 511 during the separating operation can be reduced.

Further, the contacting state between the electric contact surface 511 and the terminal portion 93 can be maintained during transportation of the image forming apparatus in which the developing cartridge 1 is inserted in the drawer unit 90. Therefore, frictional wearing of the electric contact surface 511 can further be reduced.

Incidentally, in this embodiment, the direction (separating direction) in which the developing roller 30 is moved away from the photosensitive drum during the separating operation is the second direction. However, the separating direction may be a direction other than the second direction. Alternatively, the separating direction maybe a direction crossing the first direction.

5. Modifications 5.1. First Modification

Figure 13:
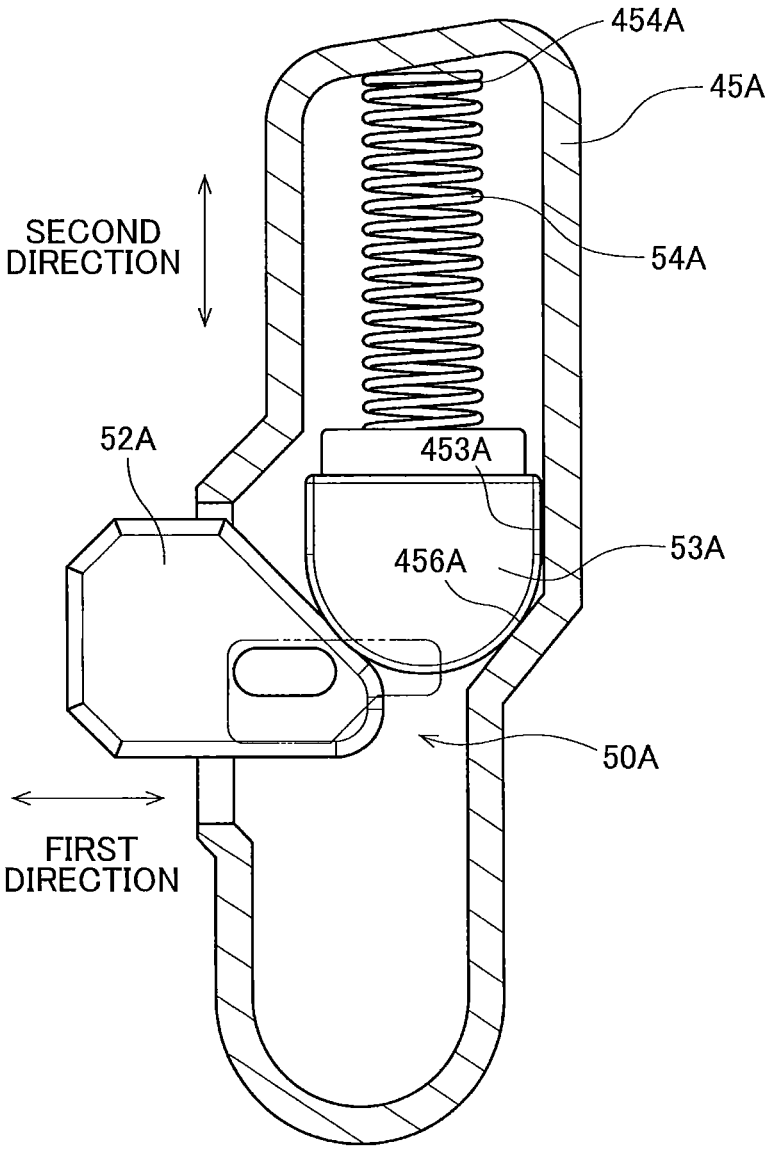
FIG. 13 is a side view of an IC chip assembly as viewed in the third direction in a developing cartridge according to a first modification.

According to a first modification as illustrated in FIG. 13, a first guide surface 453A of a cover 45A includes a sloped guide surface 456A. The sloped guide surface 456A is a flat surface extending in the third direction and crossing the first and second directions. That is, the sloped guide surface 456A is inclined with respect to a direction of an array of a coil spring 54A and a pressure member 53A. More specifically, the sloped guide surface 456A is inclined so as to approach a holder 52A with the decreasing distance from the developing roller. In other words, the sloped guide surface 456A is inclined so as to approach the holder 52A in the first direction with the increasing distance from an attachment surface 454A.

With this structure, the pressure member 53A approaches the holder 52A with the increasing distance from the attachment surface 454A. That is, the pressing force directed in the second direction of the pressure member 53A is converted into the pressing force directed in the first direction by the contact with the holder 52A, and at the same time, the pressure member 53A itself is moved in the first direction to directly press the holder 52A in the first direction. Accordingly, the pressing force of the pressure member 53A to be applied to the holder 52A in the first direction can further be increased.

5.2 Second Modification

Figure 14:
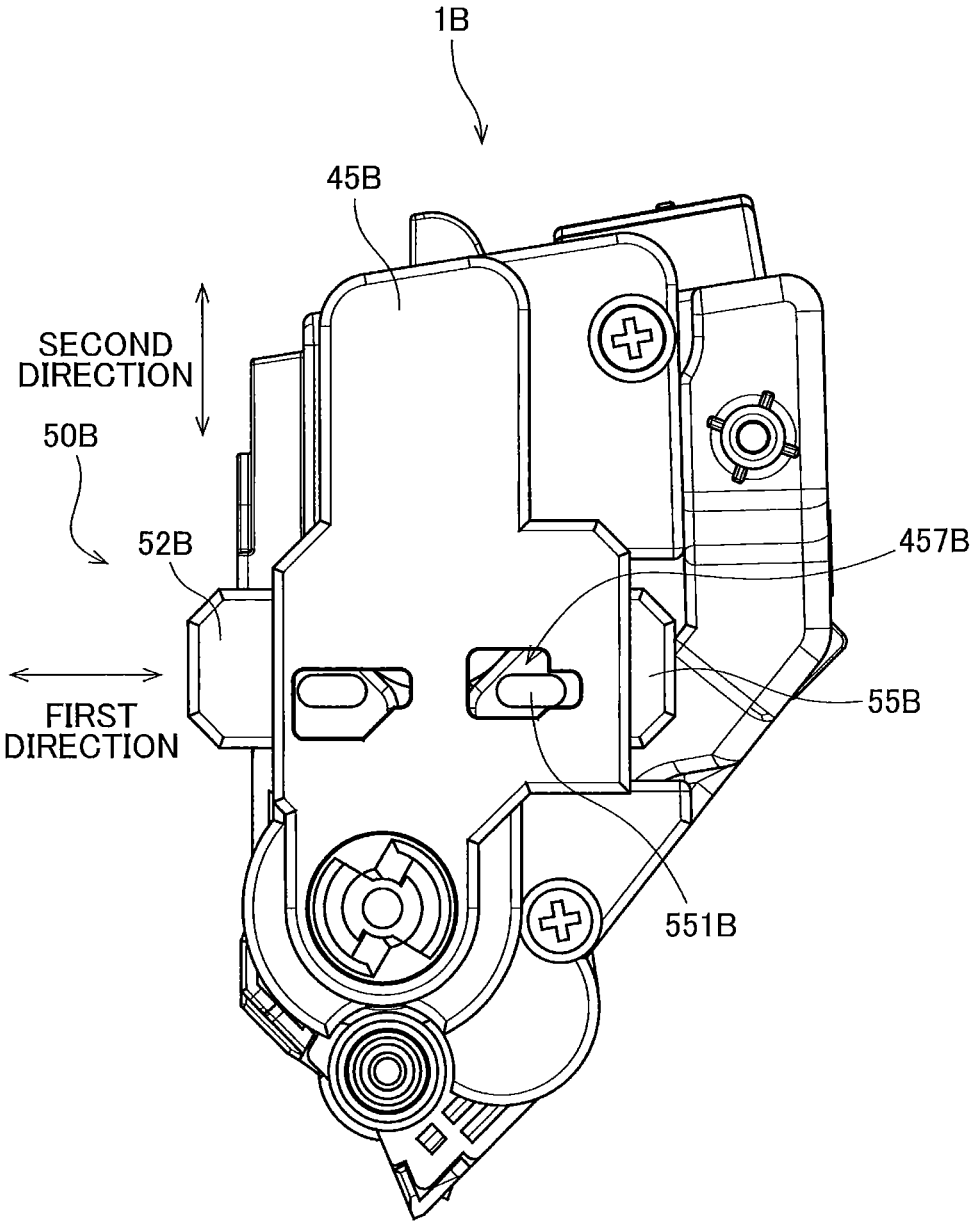
FIG. 14 is a side view of a developing cartridge according to a second modification as viewed in the third direction.
Figure 15:
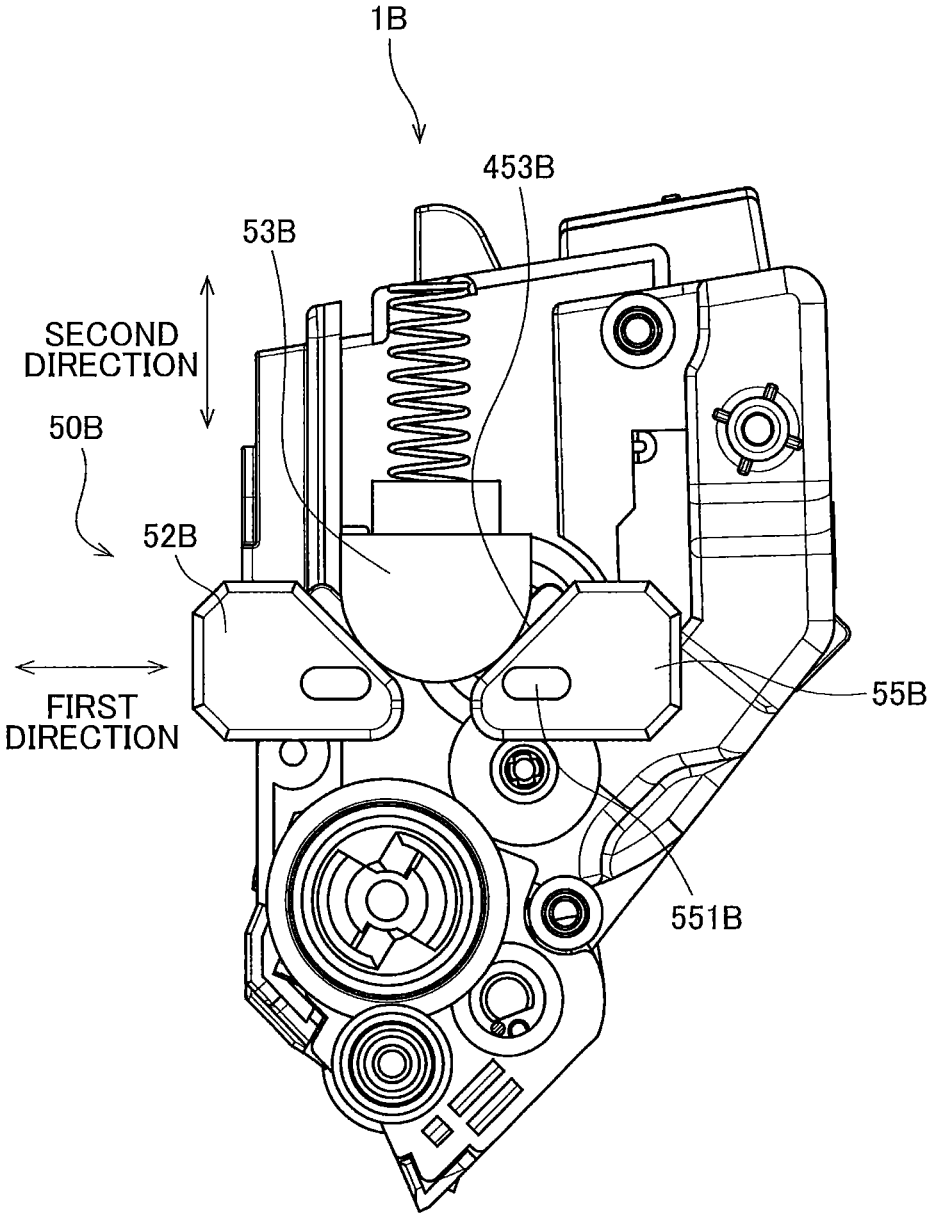
FIG. 15 is a side view of the developing cartridge according to the second modification as viewed in the third direction and illustrating a state where a cover is removed.

According to a second modification illustrated in FIGS. 14 and 15, an IC chip assembly 50B includes a guide member 55B. The guide member 55B is positioned opposite to a holder 52B in the first direction with respect to a pressure member 53B. The guide member 55B includes a first guide surface 453B. With this structure, the pressure member 53B is movable in the second direction while being guided by the first guide surface 453B.

As illustrated in FIGS. 14 and 15, the guide member 55B includes a boss 551B. The guide member 55 includes a confronting surface facing a cover 45B, and the boss 551B protrudes in the third direction toward the cover 45B from the confronting surface. Any shape of the boss 551B is available such as cylindrical and prismatic columnar shape. On the other hand, the cover 45B has a through-hole 457B extending through a thickness of the cover 45B in the third direction. The boss 551B is inserted into the through-hole 457B.

The through-hole 457B has a dimension (inner dimension) in the first direction greater than a dimension (outer dimension) of the boss 551B in the first direction. Therefore, the guide member 55B is movable along with the boss 551B in the first direction relative to a casing 10B and the cover 45B. Further, the through-hole 457B has a dimension (inner dimension) in the second direction greater than a dimension (outer dimension) of the boss 551B in the second direction.

Therefore, the guide member 55B is movable along with the boss 551B in the second direction relative to the casing 10B and the cover 45B.

With the structure thus organized, the pressure member 53B and the guide member 55B are movable away from the holder 52B in the first direction. Therefore, the movable range of the holder 52B in the second direction can be increased.

5.3 Third Modification

Figure 16:
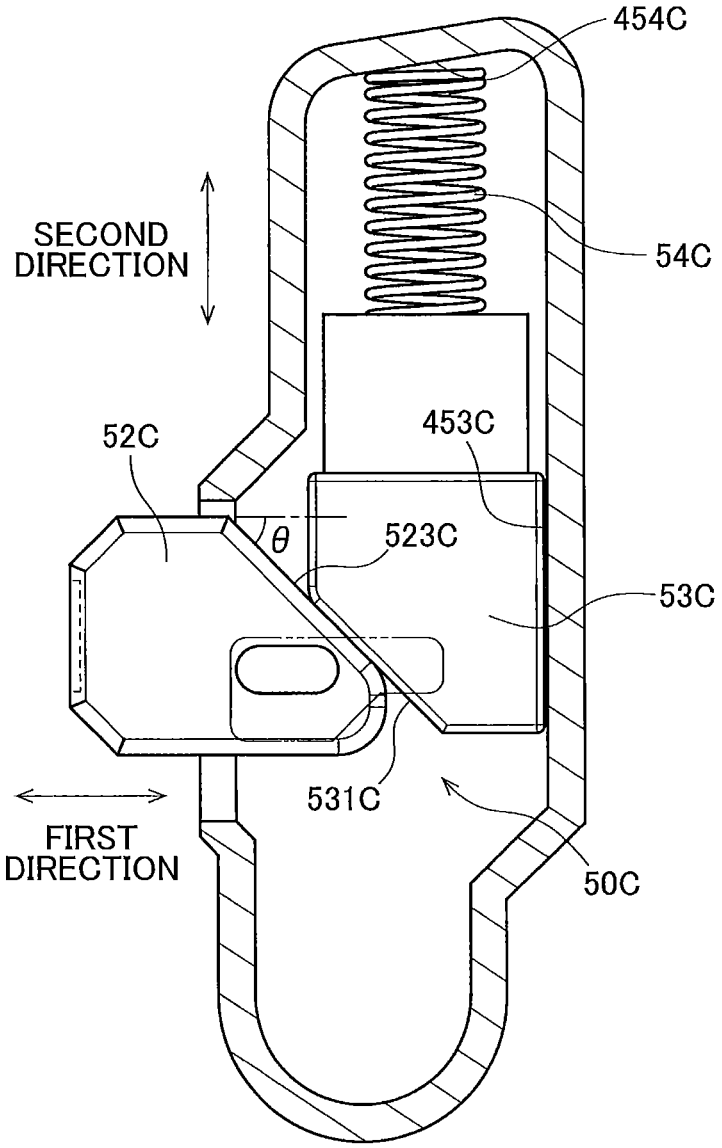
FIG. 16 is a side view of an IC chip assembly as viewed in the third direction in a developing cartridge according to a third modification.

According to a third modification illustrated in FIG. 16, a holder 52C has a first inclination surface 523C. The first inclination surface 523C is a flat surface extending in the third direction and crossing the first and second directions. More specifically, the first inclination surface 523C is inclined to be distant from the electric contact surface with the decreasing distance from the developing roller. In other words, the first inclination surface 523C is inclined to approach a first guide surface 453C with the increasing distance from an attachment surface 454C. Further, in the third modification, a pressure member 53C includes a second inclination surface 531C. The second inclination surface 531C is a flat surface extending in the third direction and crossing the first and second directions. More specifically, the second inclination surface 531C is inclined to be distant from the electric contact surface with the decreasing distance from the developing roller. In other words, the second inclination surface 531C is inclined to approach the first guide surface 453C with the increasing distance from the attachment surface 454C.

The first inclination surface 523C faces the second inclination surface 531C, and the first inclination surface 523C and the second inclination surface 531C are in contact with each other at least at the first state of the coil spring 54. With this structure, the force directing in the second direction and applied to the pressure member 53C can be converted to the force directing in the first direction by the contact between the first and second inclination surfaces 523C and 531C. Thus, the holder 52C can be pressed in the first direction.

Incidentally, in a case where an inclination angle theta (θ) of the first inclination surface 523C with respect to the first direction is too small, the force of the pressure member 53C directing in the second direction may not be effectively converted into a force for moving the holder 52 in the first direction. On the other hand, in a case where the inclination angle (θ) is too large, a sufficient moving distance of the holder 52 in the first direction may not be obtained. In this connection, the inclination angle is preferably in a range of from 30 to 60 degrees in order to provide efficient power transmission to the holder 52C and to obtain a sufficient moving distance of the holder 52C in the first direction. More preferably, the inclination angle is in a range of from 40 to 50 degrees.

5.4 Fourth Modification

Figure 17:
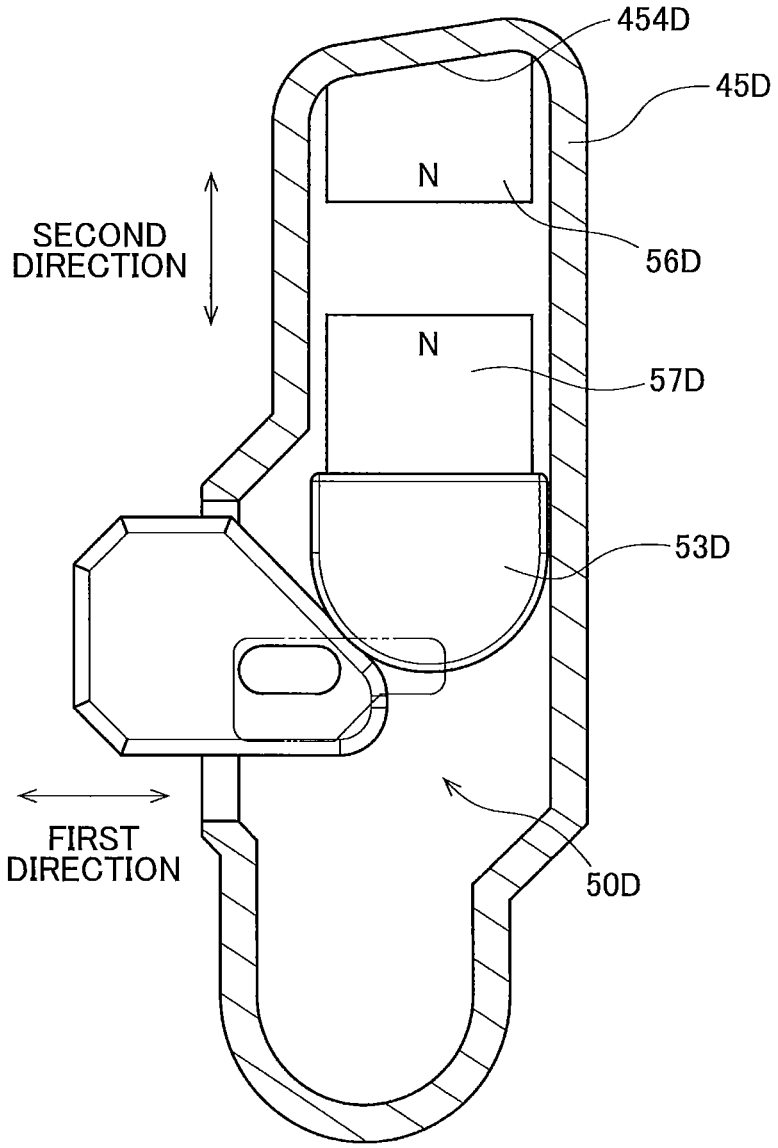
FIG. 17 is a side view of an IC chip assembly as viewed in the third direction in a developing cartridge according to a fourth modification.

According to a fourth modification illustrated in FIG. 17, an IC chip assembly 50D includes a first magnet 56D and a second magnet 57D instead of the coil spring. The first magnet 56D is fixed to an attachment surface 454D of a cover 45D. The second magnet 57D is fixed to a pressure member 53D and is movable in the second direction relative to the fixed first magnet 56D. The first and second magnets 56D, 57D include confronting surfaces having the same magnetic pole. Therefore, magnetically repelling force is generated in the second direction between the first and second magnets 56D and 57D on a continuous basis. Accordingly, the pressure member 53D receives a force in the second direction from the second magnet 57D all along the time. That is, the first and second magnets 56D, 57D are urging members for urging the pressure member 53D in a direction away from the attachment surface 454D.

In the present disclosure, the above-described coil spring 54 may be used as the urging member. Further, an elastic member other than the coil spring 54 can be used, such as a torsion spring and a leaf spring. Further, the magnets used in the fourth modification can be used as the urging member in the present disclosure.

5.5 Other Modifications

According to the above-described embodiment, the IC chip including the electric contact surface is fixed to the outer surface of the holder. However, only an electric contact surface configured to be in contact with an electrical connector may be fixed to the outer surface of the holder, and remaining portion of the IC chip other than the electric contact surface may be positioned at a remaining portion of the developing cartridge.

Further, in the above-described embodiment, the surface of the holder and the surface of the pressure member are in direct contact with each other. Preferably, at least one of the surfaces of the holder and the pressure member may be made from polyacetal resin (POM). With this configuration, friction between the holder and the pressure member can be reduced. Further, a lubrication film having low coefficient of friction may be formed over at least one of the surfaces of the holder and the pressure member. With this configuration, friction between the holder and the pressure member can be reduced. Reduction in the friction between the holder and the pressure member facilitates movement of the holder in the first direction and movement of the pressure member in the second direction. The any kind of lubrication films are available as long as the lubrication film provides friction coefficient lower than that of the surface of the member on which the lubrication film is to be formed. Grease is an example of the lubrication film.

Further, in the above-described embodiment, a portion of the cover functions as a holder casing. However, a portion of the casing accommodating the developing agent may function as a holder casing.

Further, in the above-described embodiment, the second direction which is the moving direction of the pressure member is coincident with a direction from the rotation axis (first axis) of the developing roller to the rotation axis (second axis) of the agitator. However, these directions may be different from each other. Further, in the above-described embodiment, the inserting direction of the developing cartridge into the drawer unit is coincident with the second direction. However, these directions may be different from each other.

Further, the first direction and the second direction may not be perpendicular to each other, the second direction and the third direction may not be perpendicular to each other, and the first direction and the third direction may not be perpendicular to each other.

Further, in the above-described embodiment, the gear portion performs meshing engagement between gear teeth. However, engagement with frictional force may be available instead of the meshing engagement. For example, a friction member such as rubber can be provided at the outer periphery of the meshed gears to each other instead of the plurality of gear teeth.

Further, each component used in the developing cartridge may have shape or profile different from that in the above-described embodiment. Further, various features appearing in the above described embodiment and the modifications may be suitably combined together within the scope in which conflicting combination is not generated.

While the description has been made in detail with reference to specific embodiment, it would be apparent to those skilled in the art that various changes and modifications may be made therein without departing from the spirit and scope of the above described embodiment.

What is claimed is:

1. A developing cartridge comprising:

a developing roller;

a casing configured to accommodate therein developing agent;

a storage medium including an electric contact surface;

a holder movable along with the electric contact surface in a first direction crossing the electric contact surface, the holder being movable between a first position and a second position relative to the casing in the first direction;

a holder casing configured to hold the holder;

a pressure member configured to press the holder while the pressure member moves in a second direction crossing the first direction, in a case where the holder moves between the first position and the second position; and an urging member configured to urge the pressure member, the urging member having a first state and a second state in the second direction, the urging member having one end in the second direction, and having another end in the second direction, the one end being attached to the holder casing, the another end being attached to the pressure member, wherein a distance between the one end and the another end in the first state is greater than a distance between the one end and the another end in the second state, a distance in the first direction between the electric contact surface and the pressure member in a case where the holder is positioned at the first position is greater than a distance in the first direction between the electric contact surface and the pressure member in a case where the holder is positioned at the second position, the holder is at the first position in a case where the urging member is at the first state, and the holder is at the second position in a case where the urging member is at the second state.

2. The developing cartridge according to claim 1, wherein the holder casing includes a first guide surface extending in the second direction and configured to guide the pressure member, the first guide surface being positioned opposite to the holder with respect to the pressure member.

3. The developing cartridge according to claim 2, wherein the pressure member is nipped between the holder and the first guide surface in a case where the urging member is at the first state.

4. The developing cartridge according to claim 3, wherein the first guide surface includes a sloped guide surface inclined with respect to the second direction, the sloped guide surface being approaching the holder in the first direction with an increasing distance from the one end of the urging member in the second direction.

5. The developing cartridge according to claim 1, wherein the holder includes a first inclination surface inclined with respect to the first direction and the second direction, wherein the pressure member includes a second inclination surface facing the first inclination surface, the first inclination surface and the second inclination surface contacting each other in a case where the urging member is at the first state.

6. The developing cartridge according to claim 5, wherein the first inclination surface is inclined with respect to the first direction in a range of from 30 degrees to 60 degrees.

7. The developing cartridge according to claim 1, wherein at least one of the holder and the pressure member includes a convex surface configured to be in contact with the remaining one of the holder and the pressure member.

8. The developing cartridge according, to claim 1, wherein the holder casing includes a second guide surface extending in the first direction, the holder being movable in the first direction along the second guide surface.

9. The developing cartridge according to claim 1, wherein the urging member is an elastic member expandable and shrinkable between the first state and the second state.

10. The developing cartridge according to claim 9, wherein the elastic member is a spring expandable and shrinkable in the second direction between the one end and the another end.

11. The developing cartridge according to claim 1, wherein the urging member is a magnet configured to generate a magnetic force between the one end and the another end to urge the pressure member.

12. The developing cartridge according to claim 11, wherein the magnet comprises a first magnet fixed to the holder casing at a position corresponding to the first end, and a second magnet fixed to the pressure member at a position corresponding to the another end, the first magnet and the second magnet being configured to generate a magnetically repelling force.

13. The developing cartridge according to claim 1, wherein the holder casing has one of a through-hole and a recessed portion;

wherein the holder includes a boss protruding in a direction crossing the first direction and the second direction, the boss being inserted into the one of the through-hole and the recessed portion, wherein a dimension of the one of the through-hole and the recessed portion in the first direction is greater than a dimension of the boss in the first direction.

14. The developing cartridge according to claim 1, wherein one of the holder and the pressure member includes a guide protrusion protruding toward remaining one of the holder and the pressure member, and the remaining one of the holder and the pressure member includes a guide groove engaging with the guide protrusion, the guide protrusion being movable along the guide groove in a case where the urging member is changed between the first state and the second state.

15. The developing cartridge according to claim 1, wherein the developing cartridge is insertable into one of an image forming apparatus and a unit attachable to and detachable from an image forming apparatus, wherein the second direction is a direction of inserting the developing cartridge.

16. The developing cartridge according to claim 1, wherein the developing roller is rotatable about a first axis extending in a third direction crossing the first direction and the second direction, wherein the developing cartridge further comprises an agitator rotatable about a second axis extending in the third direction, wherein the second direction is defined by connecting the first axis to the second axis.

17. A developing cartridge comprising:

a developing roller;

a casing configured to accommodate therein developing agent;

a storage medium including an electric contact surface;

a holder movable along with the electric contact surface in a first direction crossing the electric contact surface, the holder being movable between a first position and a second position relative to the casing in the first direction; and a pressure member configured to press the holder while the pressure member moves in a second direction crossing the first direction, in a case where the holder moves between the first position and the second position, wherein a distance in the first direction between the electric contact surface and the pressure member in a case where the holder is positioned at the first position is greater than a distance in the first direction between the electric contact surface and the pressure member in a case where the holder is positioned at the second position, wherein the holder is movable in the second direction relative to the casing.

* * * * *